United States Patent [19]

Kawakami et al.

[11] Patent Number: 4,604,782

[45] Date of Patent: Aug. 12, 1986

[54] METHOD AND APPARATUS FOR AUTOMATICALLY THREADING SEPARABLE SLIDE FASTENER STRINGERS THROUGH SLIDERS

[75] Inventors: Koichi Kawakami, Toyama; Mitsuo Sawada, Kurobe, both of Japan

[73] Assignee: Yoshida Kogyo K.K., Tokyo, Japan

[21] Appl. No.: 503,051

[22] Filed: Jun. 10, 1983

[30] Foreign Application Priority Data

Jun. 19, 1982 [JP] Japan ..... 57-105686

[51] Int. Cl.[4] ..... B21D 53/50; A41H 37/06

[52] U.S. Cl. ..... 29/409; 29/408; 29/768

[58] Field of Search ..... 29/408, 409, 410, 766, 29/769, 33.2

[56] References Cited

U.S. PATENT DOCUMENTS 4,122,594 10/1978 Azzara ..... 29/768
4,131,993 1/1979 Azzara ..... 29/768
4,135,285 1/1979 Weiner ..... 29/409

FOREIGN PATENT DOCUMENTS 53-69746 6/1978 Japan .

*Primary Examiner*—Howard N. Goldberg
*Assistant Examiner*—Steven Nichols
*Attorney, Agent, or Firm*—Hill, Van Santen, Steadman & Simpson

[57] ABSTRACT

A pair of separable slide fastener stringers is fed along in one plane along parallel spaced paths, respectively, toward throats of a Y-shaped guide channel in a slider fixed in position. Pins of the stringers are inserted into the guide channel through the throats, respectively. The pins as they emerge from a rear end of the slider are stopped when rows of coupling elements start intermeshing with each other within the guide channel. The separable slide fastener stringers are moved again at the same speed to bring the rows of coupling elements into intermeshing engagement.

6 Claims, 17 Drawing Figures

FIG. 10
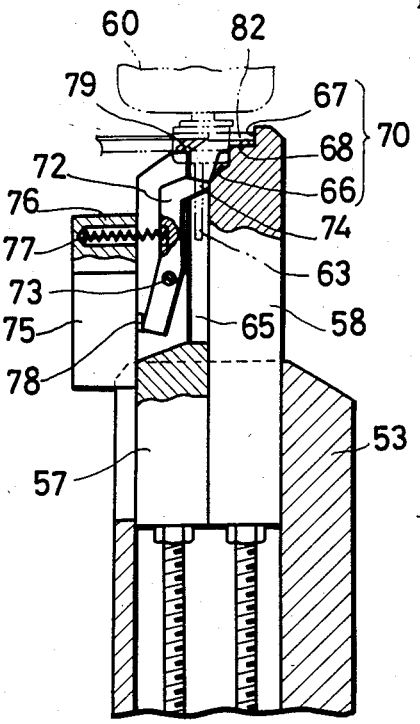
FIG. 11
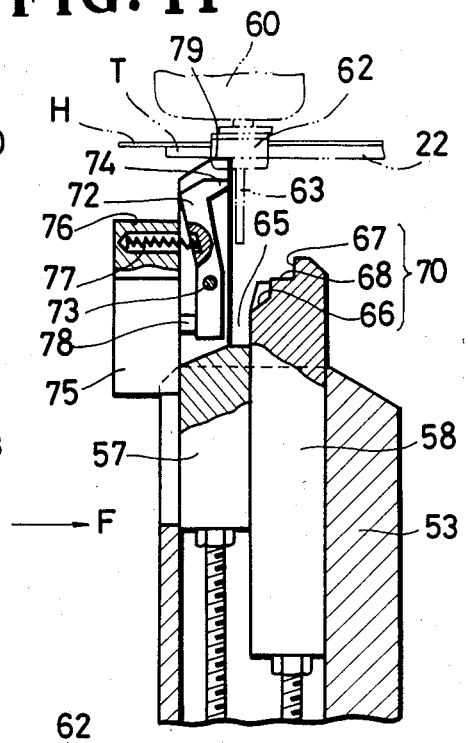
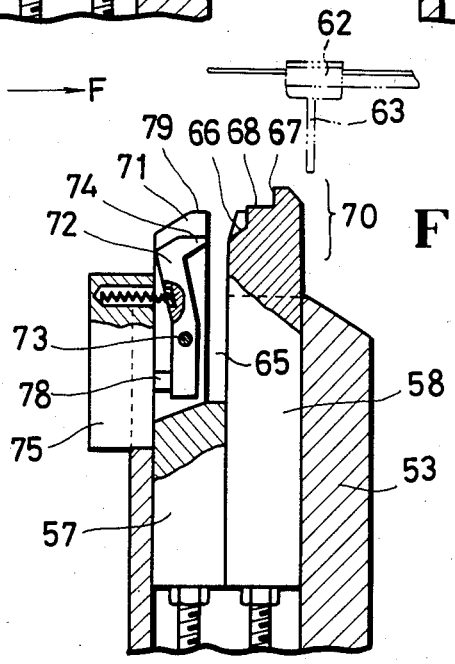
FIG. 12

METHOD AND APPARATUS FOR AUTOMATICALLY THREADING SEPARABLE SLIDE FASTENER STRINGERS THROUGH SLIDERS

BACKGROUND OF THE INVENTION

1. Field of the Invention

The present invention relates to a method of and an apparatus for automatically threading a pair of separable slide fastener stringers having pins secured to their ends, respectively, through a slider to thereby couple the slide fastener stringers into a slide fastener chain and mount the slider thereon.

2. Description of the Prior Art

Various processes have been practiced in the art for fabricating separable slide fasteners. According to one known method, auxiliary tapes are attached respectively across lower ends of separate elongate slide fastener stringers having top stops on upper ends thereof, the stringers are cut off across the tapes into desired unit stringers which are then threaded through a slider, pins are fixed to the lower ends of the stringer lengths, respectively, followed by attachment of a box to one of the pins, and finally the unit stringers are brought into mutual intermeshing engagement. Another prior process comprises the steps of attaching pins to lower ends of separate elongate slide fastener stringers with top stops mounted on their upper ends, threading one of the stringers through a slider, attaching a box to the pin of the stringer with the slider mounted thereon, and cutting off the stringers into unit stringers which are then combined into a final slide fastener product. These conventional processes however include the manual step of bringing the unit stringers into interdigitating engagement, a step which has been a serious obstacle to efforts to achieve an increased rate of production of slide fasteners.

A method of manufacturing separable slide fasteners is disclosed in Japanese Laid-Open Patent Publication No. 53-69746, assigned to the present assignee. The disclosed method is capable of fabricating separable slide fasteners highly efficiently as the entire process is automated. However, a problem is still to be solved in threading separate stringers with pins attached through a slider unobstructedly and reliably and taking the stringers into proper meshing engagement.

SUMMARY OF THE INVENTION

It is an object of the present invention to provide a method of and an apparatus for automatically threading a pair of separable slide fastener stringers with pins affixed to their ends smoothly and reliably through a slider to place the latter on the stringers and bring the stringers into proper intermeshing relation.

According to the present invention, a pair of separable slide fastener stringers is fed along in one plane along parallel spaced paths, respectively, toward throats of a Y-shaped guide channel in a slider fixed in position. Pins of the stringers are inserted into the guide channel through the throats, respectively. The pins as they emerge from a rear end of the slider are stopped when rows of coupling elements start intermeshing with each other within the guide channel. The separable slide fastener stringers are moved again at the same speed to bring the rows of coupling elements into intermeshing engagement.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 8 through 12 are vertial cross-sectional views illustrating progressive steps of threading the slide fastener stringers through the slider.

DETAILED DESCRIPTION

Figure 1:
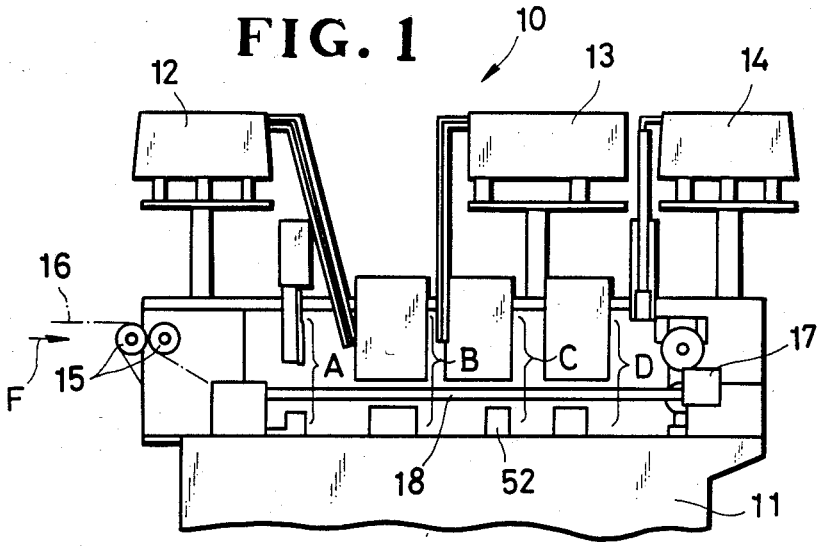
FIG. 1 is a schematic side elevational view of an entire system for automatically assembling separable slide fasteners.

FIG. 1 shows an overall system 10 for automatically assembling separable slide fasteners. The system 10 includes a cutting unit A for automatically cutting off a pair of continuous elongate slide fastener stringers 16 into a pair of unit stringers having a length equal to that of a final separable slide fastener, a pinning unit B for automatically attaching a pair of pins to ends of the stringers, respectively, a threading unit C for automatically threading the stringers through a slider and bringing the stringers into intermeshing engagement with each other, and a boxing unit D for automatically attaching a box to one of the pins fixed to the stringers. The units A, B, C and D are all mounted on a base 11. The system 10 also has a first parts feeder 12 for supplying pins to the pinning unit B, a second parts feeder 13 for supplying sliders to the threading unit C, and a third parts feeder 14 for supplying boxes to the boxing unit D. The continuous elongate slide fastener stringers 16 before they are cut off are fed along into the system 10 by a pair of guide rolls 15. The stringers are gripped and pulled by a gripper unit 17 movable along a horizontal guide rail assembly 18 mounted on the base 11.

Prior to entering the automatic assembling system 10, the continuous slide fastener stringers 16 are gapped to provide longitudinally spaced element-free spaces H (one shown in FIG. 11), and top stops T (one shown in FIG. 11) are attached to rear ends of rows of elements on the stringers 16.

The automatic assembling system 10 will operate as follows: The continuous slide fastener stringers 16 are fed along by the guide rolls 15 in the direction of the arrow F while the stringers 16 are being gripped by the gripper unit 17 (described later on) and pulled along successively through the units A, B, C and D. In the pinning unit B, pins are affixed to ends of the rows of coupling elements remote from the top stops on the stringers 16. Then, the stringers 16 are threaded through a slider in the threading unit C and are taken into interdigitating engagement as they emerge from the slider. A box is attached to one of the pins in the boxing unit D. Finally, the stringers are cut off by the cutting unit A into a length of unit stringers which will be finished as a final slide fastener product. The slide fastener stringers 16 may be cut off into unit stringers any time prior or subsequent to the steps carried out by the units B, C and D.

Figure 2:
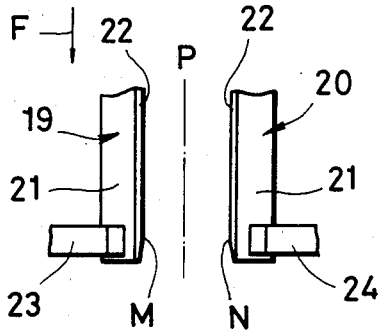
FIG. 2 is a fragmentary plan view showing the manner in which a pair of transversely spaced slide fastener stringer are held and fed along by a pair of grippers.

The present invention is particularly directed to the threading unit C for threading a pair of slide fastener stringers through a slider. The threading unit C is described in greater detail with reference to FIGS. 2 through 7. As shown in FIG. 2, the gripper unit 17 includes a pair of grippers 23, 24 for gripping the ends of slide fastener stringers 19, 20 in transversely spaced-apart relation to each other and pulling them toward the threading unit C. Each of the stringers 19, 20 is composed of a stringer tape 21 supporting a row of coupling elements 22 on one longitudinal edge thereof. The stringers 19, 20 have front end portions M, N, respectively, on which a pair of pins 82, 83 (FIG. 7) are mounted, respectively. In FIG. 2, while the stringers 19, 20 are fed along in the direction of the arrow F, they are laterally spaced from each other at equidistant positions on both sides of a central line P. The stringers 19, 20 will be interengaged into a slide fastener chain having its longitudinal central axis in alignment with the central line P.

Figure 3:
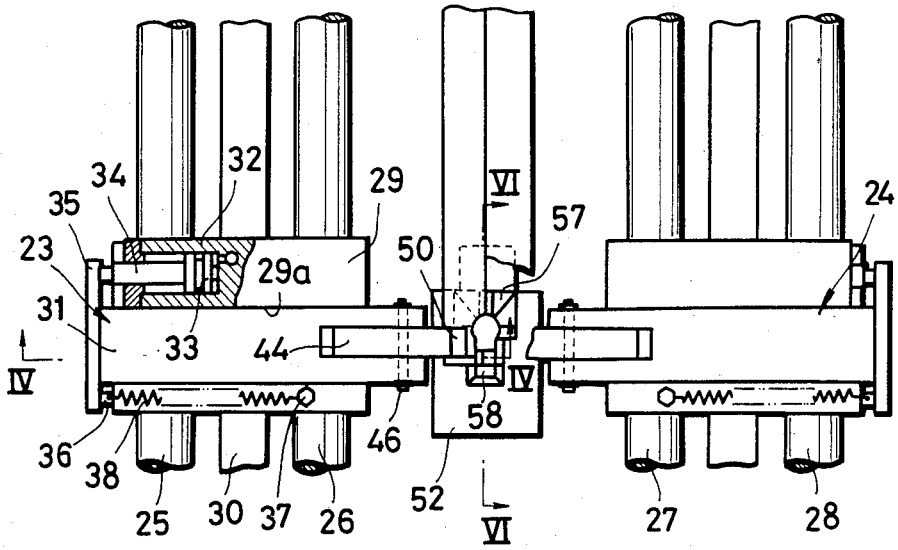
FIG. 3 is a fragmentary plan view of a threading unit for automatically threading a pair of slide fastener stringers through a slider.
Figure 4:
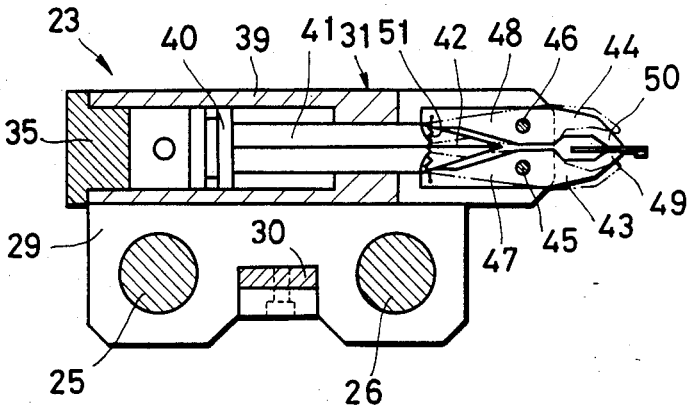
FIG. 4 is a cross-sectional view taken along line IV—IV of FIG. 3.

As illustrated in FIG. 3, the guide rail assembly 18 is composed of two pairs of parallel guide rails 25, 26 and 27, 28 spaced at equal distances from the central line P. The gripper 23 has a slide base 29 slidably fitted over the guide rails 25, 26. Likewise, the gripper 24 has a slide base slidably fitted over the guide rails 27, 28. Since the gripper 24 is the mirror image of the gripper 23, only the gripper 23 is described hereinbelow. The slide base 29 is affixed to a gripper drive belt 30 which is driven by a suitable reciprocable driving means (not shown). The gripper 23 also includes a gripper base 31 slidably fitted in a slot **29*a* in the slide base 29 and is movable in a direction normal to the central line P. A fluid cylinder 32 is defined as part of the slide base 29 for actuating the gripper base 31. A piston 33 is slidably disposed in the fluid cylinder 32 and has a piston rod 34 connected to a connector plate 35 attached to the gripper base 31. The connector plate 35 has a spring rod 36, and the slide base 29 has a spring attachment 37, there being a tension spring 38 having one end connected to the spring rod 36 and the other end to the spring attachment 37. As shown in FIG. 4, the gripper base 31 has a fluid cylinder 39 with a piston 40 slidably fitted therein, the piston 40 having a piston rod 41 including a tapered wedge 42 on its end remote from the piston 40. A pair of upper and lower gripper arms 43, 44 is pivotably mounted by a pair of pins 45, 46, respectively, on a bifurcated end of the gripper base 31. The upper and lower gripper arms 43, 44 have rear ends 47, 48, respectively, which can be brought into contact with the tapered wedge 42, and front jaws 49, 50, respectively, for gripping the stringer tape 21 therebetween. The rear ends 47, 48 are normally urged by a spring 51 to move toward each other. When the piston rod 41 is projected, its tapered edge 42 spreads apart the rear ends 47, 48 of the gripper arms 47, 48 to move the front jaws 49, 50 toward each other for gripping the stringer tape 21. When the piston rod 41 is retracted, the rear ends 47, 48 are moved toward each other under the force of the spring 51 to thereby spread apart the front jaws 49, 50, thus releasing the stringer tape 21**.

Figure 5:
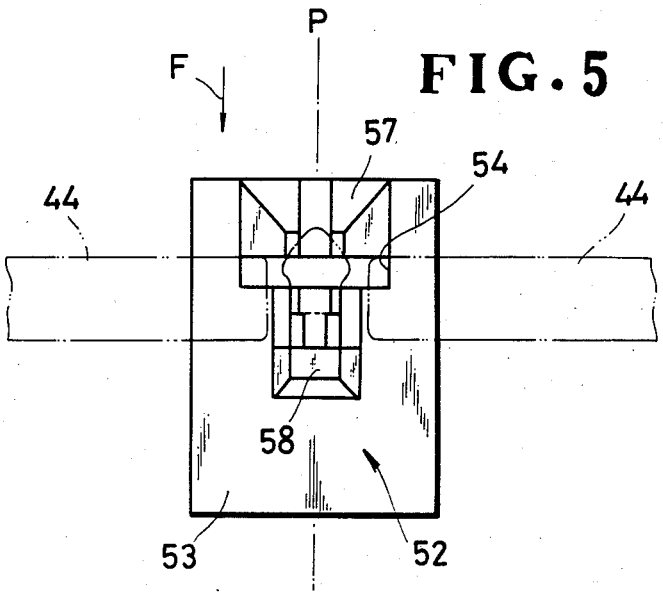
FIG. 5 is an enlarged plan view of a slider holder in the threading unit shown in FIG. 3.

As shown in FIG. 5, the threading unit C includes a slider holder 52 having a central axis aligning with the central line P. The slider holder 52 includes a holder casing 53 supported on the base 11 and having a vertical slot 54 (FIG. 6) in which two piston rods 55, 56 extend vertically from two fluid cylinders (not shown), respectively. A pair of locking and stop blocks 57, 58 is mounted on upper ends of the piston rods 55, 56, respectively, for vertical movement in the vertical slot 54. A chute 59 extends from the parts feeder 13 (FIG. 1). A feeder arm 60 is angularly movable about the axis of a shaft 61 between the chute 59 and the stop block 58 for feeding one of sliders 62 at a time from the parts feeder 13 to the stop block 32. The slider 62 has a pull tab 63 loosely pivotably attached thereto and having an aperture 64. The locking and stop blocks 57, 58 define therebetween a slit 65 for receiving therein the pull tab 63 as it depends from the slider 62 due to gravity. The stop block 58 has on its upper end a stepped portion 70 composed of a slanted slider engagement surface 66, a vertical pin stop surface 67 spaced from the slanted slider engagement surface 66, and a horizontal spacer surface 68 extending between the slanted slider engagement surface 66 and the vertical pin stop surface 67. The locking block 57 has an upper bifurcated portion 71 in which a locking lever 72 is pivotably fitted by a pin 73. The locking lever 72 has a locking pawl 74 engageable in the aperture 64 in the pull tab 63. A jig cylinder 75 is attached to a vertical surface of the locking block 57 which is remote from the stop block 58, the jig cylinder 75 being actuatable by an electromagnetic device (not shown). The jig cylinder 75 supports thereon a casing 76 having disposed therein a compression spring 77 having an end placed in a recess defined in the back of the locking lever 72 for normally urging the latter in a direction to move the locking pawl 74 into the slit 65. The jig cylinder 75 has a piston rod 78 held in abutment against a lower end of the locking lever 72. When the jig cylinder 75 is actuated, the piston rod 78 projects to push the locking lever 72 counterclockwise (FIG. 6) about the axis of the pin 73 so that the locking pawl 74 is retracted out of the slit 65 against the force of the compression spring 77. The locking block 57 has an upper end surface 79 serving as a slider mount, as described below.

Figure 7:
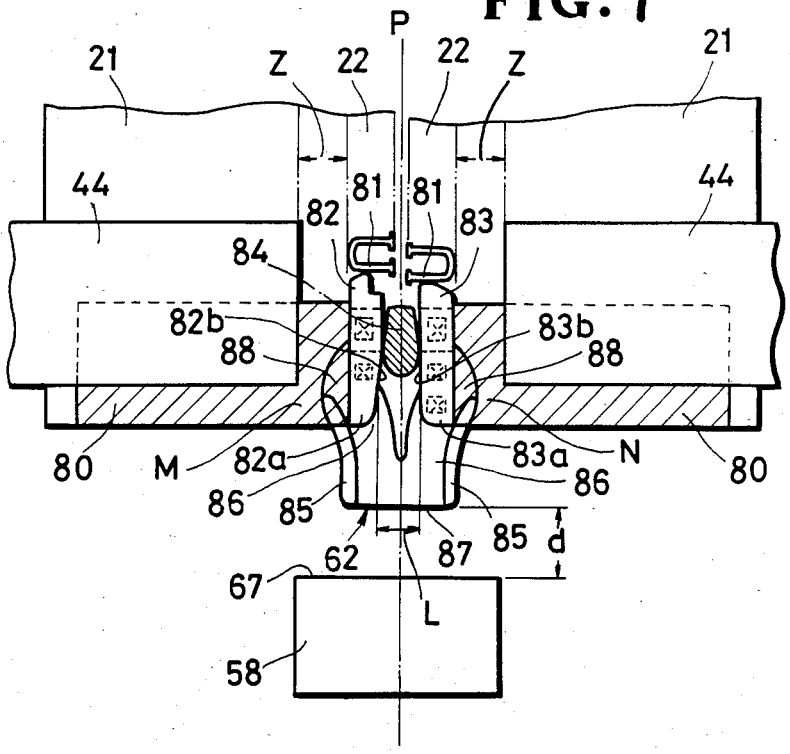
FIG. 7, appearing with FIG. 5, is a plan view of a slider supported on the slider holder and a pair of slide fastener stringers as they are threaded into the slider.
Figure 6:
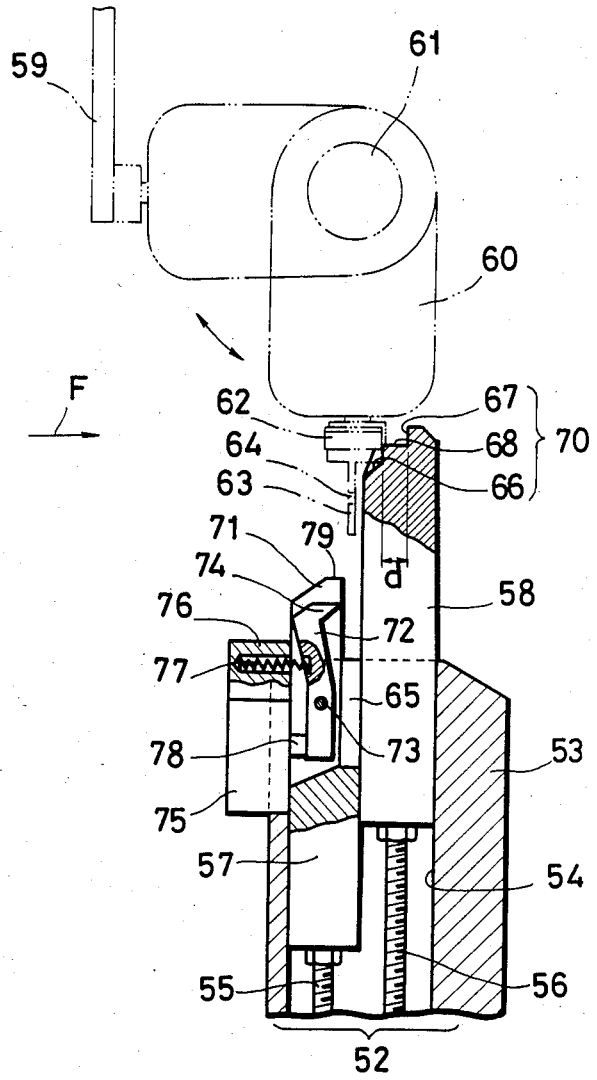
FIG. 6 is a vertical cross-sectional view of the slider holder with a slider imaginarily shown supplied from a chute by a slider feeder arm.

As illustrated in FIG. 7, the stringer tapes 21, 21 have films 80, 80, respectively, applied to their ends for preventing the tape ends from fraying. A pair of pins 82, 83 is attached to the stringer tapes 21, 21, respectively, at their ends on the confronting edges of the tapes 21, 21. The rows of coupling elements 22, 22 include lowermost elements 81, 81 held in contact with the pins 82, 83, respectively. The pins 82, 83 have respective ends **82*a*, 83*a* and respective side surfaces 82*b*, 83*b* confronting each other. A box (not shown) will be secured to the pin 83 in the unit D so that the pin 82 can be fitted in the box. The slider 62 to be slidably mounted on the stringer tapes 21, 21 includes a diamond or connector post 84 interconnecting upper and lower slider wings, and a pair of flanges 85, 85 mounted on each slider wing and defining a generally Y-shaped guide channel 86 in cooperation with the diamond 84. The Y-shaped guide channel 86 has a rear end 87 remote from the diamond 84 and a pair of throats 88, 88 disposed one on each side of the diamond 84**.

Operation of the threading unit C of the foregoing construction is as follows:

The stringers 19, 20 with the pins 82, 83 attached thereto, respectively, in the pinning unit B are gripped by the grippers 23, 24 as shown in FIG. 2 and pulled thereby in the direction of the arrow F in mutually spaced relation toward the threading unit C. At this time, the fluid cylinder 39 in each of the grippers 23, 24 is actuated to push the piston rod 41 for causing the wedge 42 to close the gripping jaws 49, 50 against the force of the spring 51 to thereby grip the stringer tape 21. The slide bases 29 are caused by the gripper drive belts 30 to slide along the guide rails 25, 26 and 27, 28 to thereby feed the stringers 19, 20. Just prior to arrival at the threading unit C, the fluid cylinder 32 in each of the grippers 23, 24 is inactivated to allow the gripper base 31 to move toward the central line P under the force of the spring 38. During this time, the pistons 33 in the grippers 23, 24 are controlled under fluid pressure to keep the distal ends 82*a*, 83*b* of the pins 82, 83 spaced from each other by a distance L which is slightly greater than the width of the diamond 84, as shown in FIG. 7. As the front ends of the stringers 19, 20 approach the threading unit C, one of the sliders 62 is supplied by the feeder arm 60 (FIG. 6) from the chute 59 to the slanted slider engagement surface 66 on the stop block 58 as it is raised.

Figure 8:
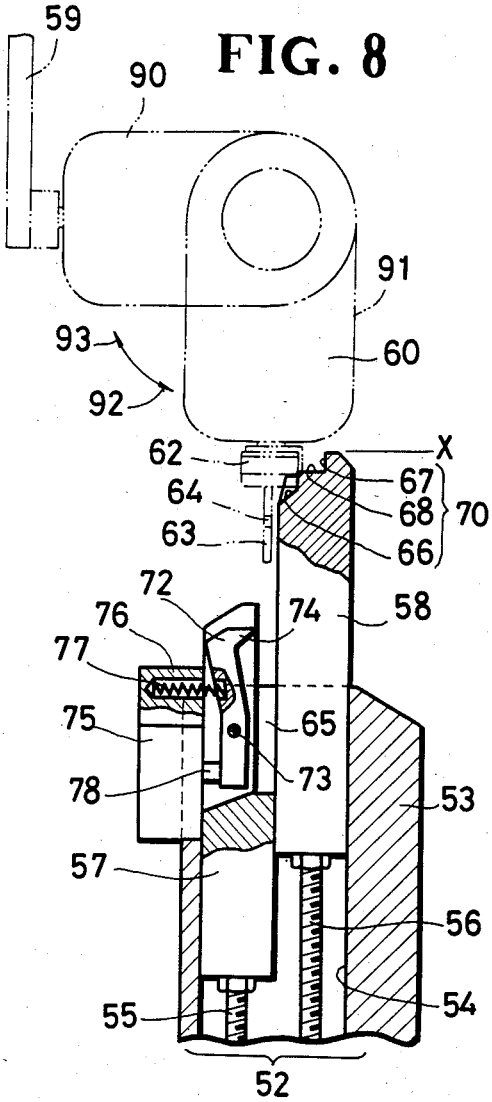

More specifically, the feeder arm 60 with the slider 62 received from chute 59 is moved substantially through an angle of 90° counterclockwise in the direction of the arrowhead 92 (FIG. 8) from a horizontal position 90 to a vertical position 91 in which the slider 62 is held in engagement with the slanted slider engagement surface 66 of the stop block 58 with its upper surface in an uppermost position X.

Figure 9:
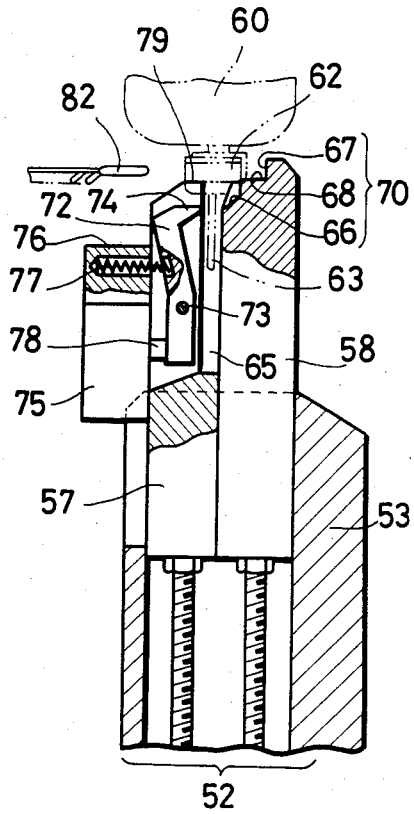

Then, the locking block 57 is lifted to allow the depending pull tab 63 to be received in the slit 65 and to enable the slider mount 79, the slanted slider engagement surface 66, and the feeder arm 60 to hold the slider 62 firmly in position, as illustrated in FIG. 9.

When the jig cylinder 75 is inactivated, the piston rod 78 is retracted and the locking pawl 74 of the locking lever 72 is forced under the bias of the spring 77 to enter the aperture 64 in the pull tab 63 positioned in the slit 65 for thereby locking the slider 62 securely in place. Where the slider 62 is of the automatic locking type, a locking prong is retracted out of the guide channel in the slider 62 at this time. With the slider 62 thus positioned, the stringers 19, 20 are introduced into the Y-shaped guide channel 86 through the throats 88, 88, respectively. The insertion of the stringers 19, 20 is stopped when the pins 82, 83 engage the vertical pin stop surface 68 on the stop block 58, as shown in FIG. 10.

The jig cylinder 75 is actuated again to project the piston rod 78 for retracting the locking pawl 74 out of the aperture 64 in the pull tab 63. At the same time, the stop block 58 is lowered to its lowermost position, as shown in FIG. 11. The slider 62 is now supported by the slider mount 79 of the locking block 57 and the feeder arm 60. Simultaneously, the grippers 23, 24 are actuated again to resume the feeding of the stringers 19, 20 at the same speed of travel in the direction of the arrow F. The stringers 19, 20 are now brought into proper intermeshing engagement in the slider 62 as they are pulled along by the grippers 23, 24.

When the top stops T (FIG. 11) secured to the rear ends of the rows of coupling elements 22, 22 engage the slider 62 at the throats 88 therein, the slider 62 is forcibly pulled by the top stops T off the locking block 57 and the feeder arm 60. Then, the locking block 57 is moved downwardly as shown in FIG. 12. The feeder arm 60 is moved about the axis of the shaft 61 counterclockwise in the direction of the arrow 93 (FIG. 8) substantially through an angle of 90° back to the horizontal position 90 for receiving a next slider from the chute 59. The stop block 58 is raised again to the uppermost position X shown in FIG. 8 in preparation for resuming the foregoing cycle.

The manner in which the stringers 19, 20 are threaded through the slider 62 is described in greater detail.

As illustrated in FIG. 7, the gripping jaws 44, 44 of the grippers 23, 24 are spaced from the elements 81, 81 and the pins 82, 83 at the front end portions M, N by distances Z transversely of the stringer tapes 21, 21. As described above, the grippers 23, 24 are slid along the guide rails 25–28 to pull the stringers 19, 20 in the same plane along parallel paths while maintaining the ends 82*a*, 83*a* of the pins 82, 83 spaced apart from each other by the distance L. The slider 62 is engaged by the slanted slider engagement surface 66 with the throats 88 in the slider 62 being positioned in the plane in which the stringers 19, 20 are travelling. At this time, the rear end 87 of the guide channel 86 is spaced a distance d from the vertical stop surface 67 of the stop block 58.

Figure 13:
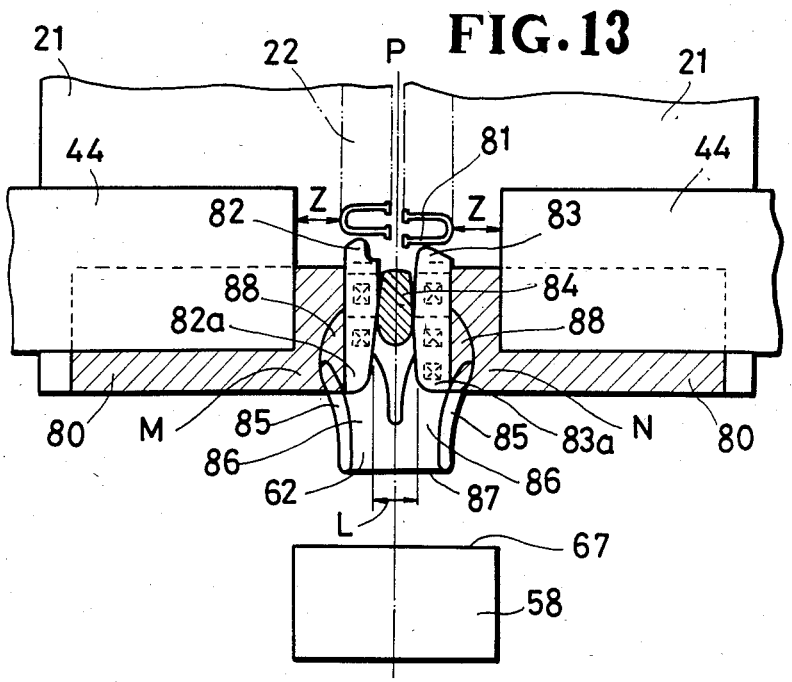
FIGS. 13 through 17 are plan views showing progressive steps of threading the slide fastener stringers through the slider.

The front end portions M, N of the stringers 19, 20 are introduced into the Y-shaped guide channel 86 through the throats 88, 88, respectively. As the stringers 19, 20 progress, the distal ends 82*a*, 83*a* of the pins 82, 83 are brought into abutment against inner surfaces of the flanges 85, 85, as shown in FIG. 13.

Figure 14:
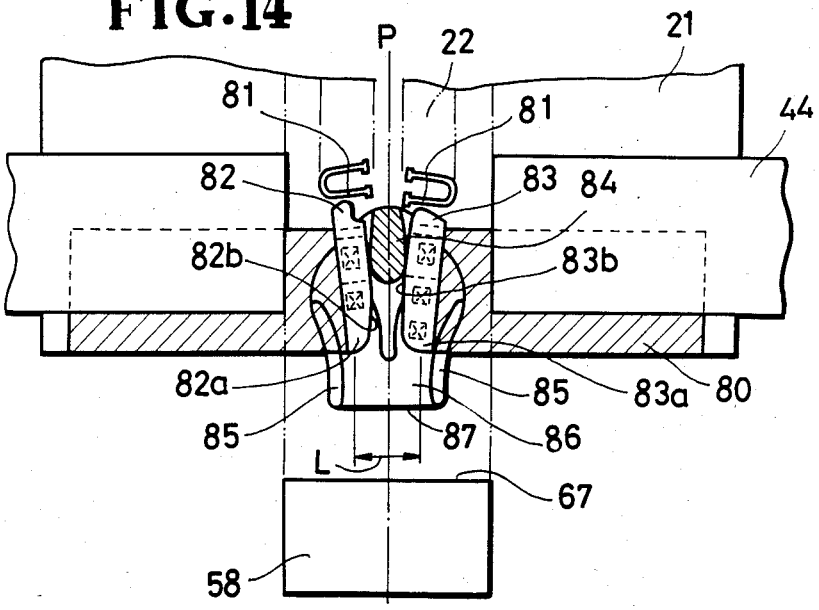

Continued advancing movement of the stringers 19, 20 causes the distal ends 82*a*, 83*a* of the pins 82, 83 to be directed toward each other as they are guided by the inner surfaces of the flanges 85, 85, as illustrated in FIG. 14. At the same time, the inner edges 82*b*, 83*b* of the pins 82, 83 are brought into sliding engagement with side surfaces of the diamond 84. Since the stringer tapes 21, 21 are relatively flexible, the grippers 23, 24 can pull the stringers 19, 20 continuously in the same plane along the parallel paths even when the pins 82, 83 start to be inclined with respect to the central line P.

Figure 15:
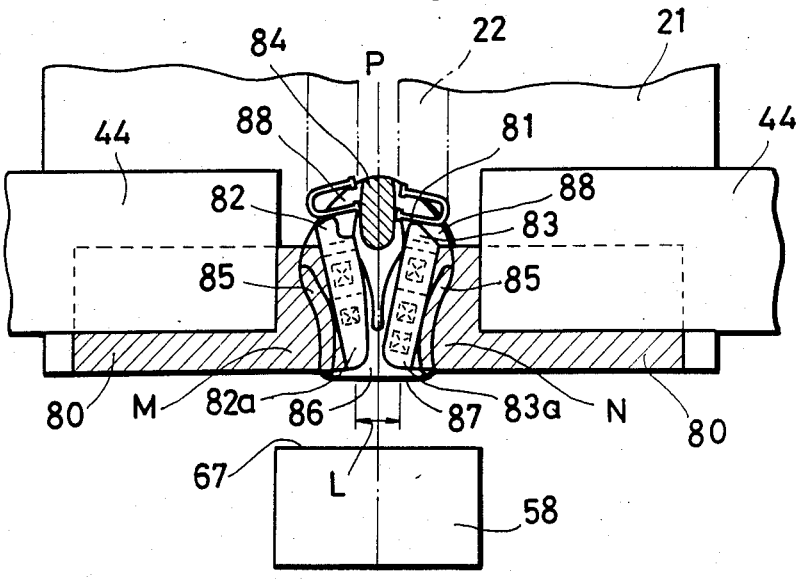

As the pins 82, 83 enter the slider 62, they become more inclined and the elements 81, 81 begin to be inserted into the Y-shaped guide channel 86 through the throats 88, 88 and to be inclined along the side surfaces of the diamond 84, as shown in FIG. 15. The stringer tapes 21, 21 are caused to flex further, but the grippers 23, 24 are still allowed to pull the stringers 19, 20 parallel to each other.

Figure 16:
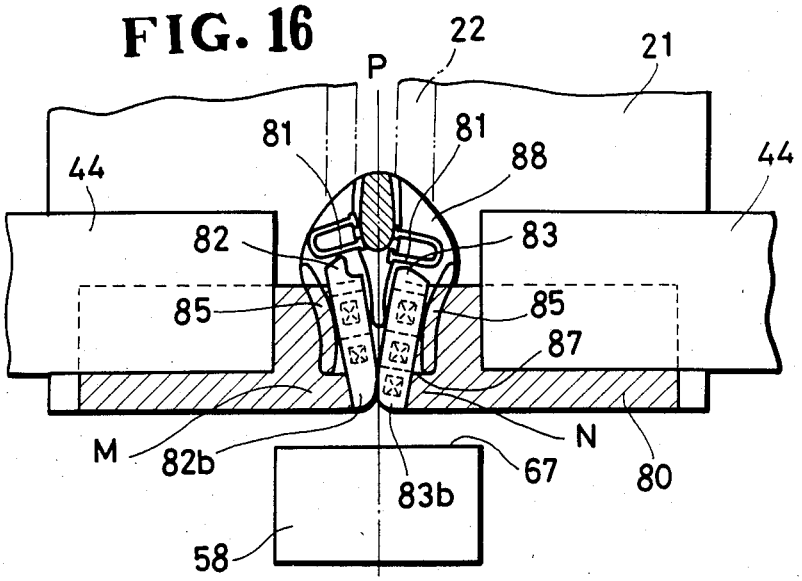

The front end portions M, N of the stringers 19, 20 then emerge from the rear end 87 and the distal ends 82*a*, 83*a* of the pins 82, 83 are brought into mutual contact with each other, as illustrated in FIG. 16, for transverse alignment with each other. The grippers 23, 24 still pull the stringers 19, 20 parallel to each other.

Figure 17:
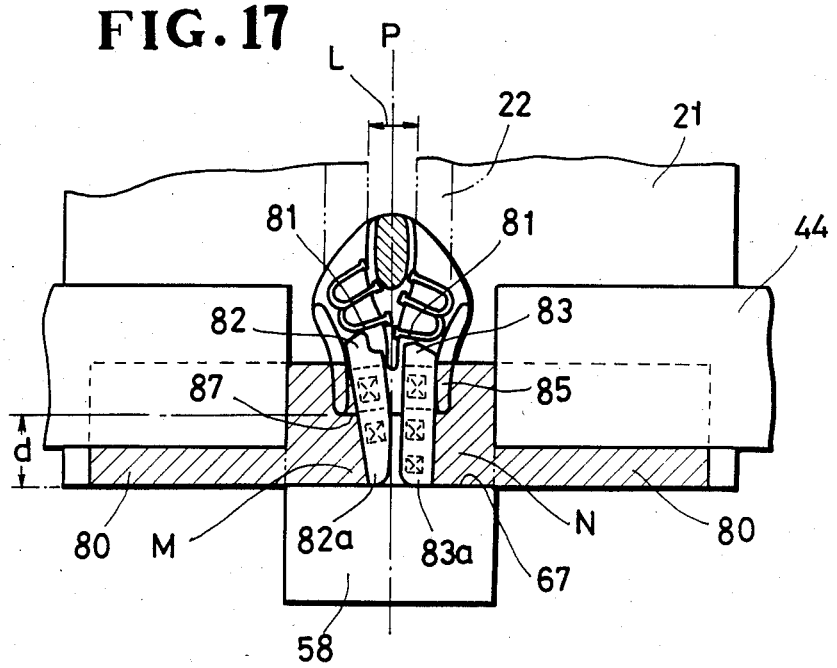

When the distal ends 82*a*, 83*a* of the pins 82, 83 abut against the vertical pin stop surface 67 of the stop block 58, the advancing movement of the stringers 19, 20 is arrested as shown in FIG. 17. At this time, the coupling elements 81, 81 adjacent to the pins 82, 83 are in a position to start intermeshing with each other in the Y-shaped guide channel 86. To assure reliable abutting engagement of the pin ends 82*a*, 83*a* against the vertical pin stop surface 67 and to enable the coupling elements 81, 81 to start intermeshing correctly with each other, the front end portions M, N of the stringers 19, 20 are kept pressed against the vertical pin stop surface 67 for a few seconds. To this end, the gripper drive belts 30 (FIG. 3) for driving the grippers 23, 24 are driven by a servomotor (not shown) which can produce a continuous low torque to press the pin ends 82*a*, 83*a* against the vertical pin stop surface 67.

The stop block 58 is then lowered to leave the slider 62 held only by the locking block 57 and the feeder arm 60. The grippers 23, 24 are advanced simultaneously at the same speed to permit the stringers 19, 20 to pass through the Y-shaped guide channel 86 in the slider 62. During this time, the rows of coupling elements 22, 22 are brought by the slider 62 into correct intermeshing engagement with each other. Accordingly, the stringers 19, 20 are combined into a slide fastener chain with the slider 62 slidably mounted thereon. The locking block 57 is then lowered to free the slider 62 as mounted on the stringers 19, 20, as shown in FIG. 12.

With the arrangement of the present invention, a pair of slide fastener stringers can be properly and efficiently threaded through a slider automatically as the stringers are fed along parallel and straight paths in the same plane into the slider. Since the pins on the stringers are stopped by the vertical pin stop surface for transverse alignment, the rows of coupling elements can be correctly interengaged by the slider. Finished separable slide fasteners are therefore quite smooth and durable in operation.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of automatically threading a pair of separable slide fastener stringers including rows of coupling elements and pins on ends of the rows of coupling elements through a slider having a guide channel including a pair of throats and a rear end, said method comprising the steps of:

(a) moving the separable slide fastener stringers in one plane along parallel spaced paths, respectively, toward the throats in the slider fixed in position;

(b) inserting the pins into the guide channel through said throats, respectively, in said fixedly positioned slider;

(c) stopping said pins as they emerge from the rear end of the slider when the rows of coupling elements start intermeshing with each other within said guide channel; and (d) moving said separable slide fastener stringers again at the same speed to bring said rows of coupling elements into intermeshing engagement.

2. A method according to claim 1, including the steps of supporting said slider before said stringers reach the slider and releasing said slider after said rows of coupling elements have been interengaged.

3. A method according to claim 1, said pins being brought into transverse alignment with each other when they are stopped.

4. An apparatus for automatically threading a pair of separable slide fastener stringers having rows of coupling elements and pins on ends of the rows of coupling elements through a slider having a guide channel including a rear end, said apparatus comprising:

(a) a pair of grippers including a pair of gripper bases, respectively, each supporting thereon a pair of pivotable gripper arms for gripping therebetween one of the separable slide fastener stringers;

(b) a plurality of guide rails on which said grippers are slidably movable to feed said separable slide fasteners along parallel spaced paths having a central line therebetween;

(c) a slider holder interposed transversely between said grippers for holding the slider to allow the separable slide fastener stringers fed by said grippers to enter said slider, said slider holder having a slider engagement surface and a pin stop surface spaced therefrom, said slider engagement surface being aligned with said central line; and (d) said pin stop surface being spaced a distance from the rear end of said slider held in engagement with said slider engagement surface such that said rows of coupling elements start intermeshing with each other in said slider when said pins as they emerge from said rear end abut against said pin stop surface.

5. An apparatus according to claim 4, said slider holder including a stop block slidably movable therein up to a position between said parallel spaced paths, said slider engagement surface and said pin stop surface being defined on said stop block.

6. An apparatus according to claim 5, said slider holder further including a locking block slidably movable therein for locking said slider in coaction with said stop block between said parallel spaced paths.

* * * * *